US011761446B2

(12) United States Patent
Ziolkowski, Jr. et al.

(10) Patent No.: US 11,761,446 B2
(45) Date of Patent: Sep. 19, 2023

(54) SCROLL COMPRESSOR WITH ENGINEERED SHARED COMMUNICATION PORT

(71) Applicant: TRANE INTERNATIONAL INC., Davidson, NC (US)

(72) Inventors: Joseph E. Ziolkowski, Jr., Onalaska, WI (US); Eric S. Mlsna, Cashton, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/491,159

(22) Filed: Sep. 30, 2021

(65) Prior Publication Data

US 2023/0103065 A1 Mar. 30, 2023

(51) Int. Cl.

| | |
|---|---|
| ***F04C 29/12*** | (2006.01) |
| ***F04C 18/02*** | (2006.01) |
| ***F01C 1/02*** | (2006.01) |

(52) U.S. Cl.

CPC ..... *F04C 29/12* (2013.01); *F01C 1/0253* (2013.01); *F04C 18/0253* (2013.01); *F04C 18/0215* (2013.01)

(58) Field of Classification Search

CPC .. F04C 29/12; F04C 18/0253; F04C 18/0215; F01C 1/0253

See application file for complete search history.

(56) References Cited

U.S. PATENT DOCUMENTS 4,514,150 A 4/1985 Hiraga et al.
5,674,058 A 10/1997 Matsuda et al.
(Continued)

FOREIGN PATENT DOCUMENTS

CN 102364107 A 2/2012
CN 111536043 A 8/2020
(Continued)

OTHER PUBLICATIONS

English Machine Translation of JP2020133407A translated on Sept. 6, 2022 (Year: 2020).*
English Machine Translation of JP 2012-127222A via PE2E (Year: 2012).*
Merriam-Webster Dictionary Definition of the word "COMET" on the Internet (Year: 2023).*
(Continued)

*Primary Examiner* — Dominick L Plakkoottam
*Assistant Examiner* — Paul W Thiede
(74) *Attorney, Agent, or Firm* — Hamre, Schumann, Mueller & Larson, P.C.

(57) ABSTRACT

An asymmetric scroll compressor includes a compressor housing. An orbiting scroll member and a non-orbiting scroll member disposed within the compressor housing. The orbiting scroll member and the non-orbiting scroll member each includes a baseplate and a wrap extending from the baseplate. The orbiting scroll member and the non-orbiting scroll member intermeshed to form a plurality of compression pockets. A driveshaft affixed to the orbiting scroll member and configured to orbit the orbiting scroll member from a first orbital position to a second orbital position. A communication port disposed on the baseplate of one of the orbiting scroll member and the non-orbiting scroll such that: in the first orbital position, the communication port communicates with a first enclosed pocket of the plurality of compression pockets, and in the second orbital position, the communication port communicates with a second enclosed pocket of the plurality of compression pockets.

20 Claims, 9 Drawing Sheets

(56) References Cited

U.S. PATENT DOCUMENTS

| | | | | |
|---|---|---|---|---|
| 5,722,257 | A * | 3/1998 | Ishii | F04C 29/0035 62/505 |
| 6,196,816 | B1 | 3/2001 | Lifson et al. | |
| 6,517,332 | B1 | 2/2003 | Lifson et al. | |
| 6,694,750 | B1 | 2/2004 | Lifson et al. | |
| 7,299,649 | B2 * | 11/2007 | Healy | F25B 1/04 62/324.4 |
| 8,186,970 | B2 | 5/2012 | Cho | |
| 9,181,945 | B2 | 11/2015 | Takeda et al. | |
| 9,297,381 | B2 | 3/2016 | Kinnaird et al. | |
| 10,227,984 | B2 | 3/2019 | Koyama et al. | |
| 10,808,698 | B2 | 10/2020 | Choi et al. | |
| 10,890,184 | B2 | 1/2021 | Iwatake et al. | |
| 11,053,939 | B2 | 7/2021 | Iwatake et al. | |
| 2003/0133819 | A1 * | 7/2003 | Perevozchikov | F04C 29/023 418/55.6 |
| 2009/0297380 | A1 | 12/2009 | Stover et al. | |
| 2010/0158731 | A1 | 6/2010 | Akei et al. | |
| 2012/0294748 | A1 * | 11/2012 | Shiibayashi | F04C 29/0007 418/55.1 |
| 2014/0119972 | A1 * | 5/2014 | Ijiri | F04C 18/0215 418/55.6 |
| 2016/0032924 | A1 | 2/2016 | Stover | |
| 2016/0230564 | A1 * | 8/2016 | Mongillo, Jr. | F01D 5/20 |

FOREIGN PATENT DOCUMENTS

| | | | |
|---|---|---|---|
| CN | 212202465 | U | 12/2020 |
| JP | 2012127222 | A * | 7/2012 |
| JP | 2017015058 | A | 1/2017 |
| JP | 2020133407 | A | 8/2020 |

OTHER PUBLICATIONS

International Search Report and Written Opinion, International Patent Application No. PCT/IB2022/059362, dated Jan. 12, 2023 (9 pages).

* cited by examiner

SCROLL COMPRESSOR WITH ENGINEERED SHARED COMMUNICATION PORT

FIELD

This disclosure generally relates to a scroll compressor. More specifically, this disclosure relates to communicating an intermediate pressure fluid with an asymmetric scroll compressor in a heating, ventilation, air conditioning, and refrigeration ("HVACR") system.

BACKGROUND

A heating, ventilation, air conditioning, and refrigeration ("HVACR") system generally includes a compressor, such as a scroll compressor. Scroll compressors include a pair of scroll members which orbit relative to each other to compress a working fluid. The wraps on the pair of scrolls in an asymmetric scroll compressor have different shapes, lengths, curvatures, or a combination thereof. The asymmetric scroll compressor compresses the working fluid (e.g., refrigerant, refrigerant mixture, or the like) at a lower pressure and discharges the fluid at a higher pressure.

SUMMARY

This disclosure generally relates to a scroll compressor. More specifically, this disclosure relates to communicating an intermediate pressure fluid with an asymmetric scroll compressor in a heating, ventilation, air conditioning, and refrigeration ("HVACR") system.

By providing a communication port shared between two adjacent compression pockets, an asymmetric scroll compressor can receive or discharge working fluid at an intermediate pressure. Injecting the working fluid at the intermediate pressure into the asymmetric scroll compressor can increase mass flow and/or efficiency of the compressor. By discharging the working fluid at the intermediate pressure and circulating the discharged working fluid back to a suction inlet of the compressor, the capacity of the compressor can be controlled while conserving the energy consumption of the compressor. Finally, by discharging working fluid at the intermediate pressure and circulating the discharged working fluid to the discharge line of the compressor, the power consumption can be controlled to the benefit of compressor efficiency.

According to one embodiment, an asymmetric scroll compressor includes a compressor housing. An orbiting scroll member and a non-orbiting scroll member disposed within the compressor housing. The orbiting scroll member and the non-orbiting scroll member each includes a baseplate and a wrap extending from the baseplate. The orbiting scroll member and the non-orbiting scroll member intermeshed to form a plurality of compression pockets. A driveshaft affixed to the orbiting scroll member and configured to orbit the orbiting scroll member from a first orbital position to a second orbital position. A communication port disposed on the baseplate of one of the orbiting scroll member and the non-orbiting scroll such that: in the first orbital position, the communication port communicates with a first enclosed pocket of the plurality of compression pockets, and in the second orbital position, the communication port communicates with a second enclosed pocket of the plurality of compression pockets.

In an embodiment, the orbiting scroll member has an intermediate orbital position between the first orbital position and the second orbital position, and during the intermediate orbital position, the communication port communicates with both the first enclosed pocket and the second enclosed pocket.

In an embodiment, the first enclosed pocket and the second enclosed pocket are adjacent in a radial direction and separated by one of the wraps.

In an embodiment, the first enclosed pocket and the second enclosed pocket are at or about a same pressure between the first orbital position and the second orbital position.

In an embodiment, the asymmetric scroll compressor includes a porous structure disposed in the communication port, the communication port configured to transfer fluid through the porous structure, and the porous structure configured to mitigate wear on a tip seal disposed on one of the wraps.

In an embodiment, the communication port is disposed within the baseplate of the non-orbiting scroll member.

According to another embodiment, a method of communicating working fluid at an intermediate pressure with an asymmetric scroll compressor. The asymmetric scroll compressor includes orbiting an orbiting scroll member affixed to a driveshaft from a first orbital position to a second orbital position to intermesh with a non-orbiting scroll member of the asymmetric scroll compressor, forming a plurality of compression pockets. The method further includes receiving the working fluid at a suction pressure from a suction intake disposed between the orbiting scroll member and the non-orbiting scroll member. The method further includes enclosing the working fluid in the suction intake to obtain a first enclosed pocket of the plurality of enclosed pocket. The method further includes communicating the working fluid at an intermediate pressure from a communication port such that: in the first orbital position, communicating with the first enclosed pocket of the plurality of compression pockets via the communication port, and in the second orbital position, communicating with a second enclosed pocket of the plurality of compression pockets via the communication port. The method further includes discharging the working fluid at a discharge pressure through a discharge outlet.

In an embodiment, the method includes communicating with both the first enclosed pocket and the second enclosed pocket via the communication port in an intermediate orbital position, the intermediate orbital position being between the first orbital position and the second orbital positon.

In an embodiment, the orbiting scroll member and the non-orbiting scroll member each includes a baseplate and a wrap extending from the baseplate, and the first enclosed pocket and the second enclosed pocket are adjacent in a radial direction and separated by one of the wraps.

In an embodiment, the method includes maintaining the first enclosed pocket and the second enclosed pocket at or about a same pressure at the intermediate orbital position.

In an embodiment, the method includes orbiting the orbital scroll member from a suction orbital position to the first orbital position to enclose the working fluid in the suction intake.

According to yet another embodiment, a refrigerant circuit. The refrigerant circuit includes a compressor, an expander, a condenser, and an evaporator fluidly connected. The compressor includes a compressor housing. An orbiting scroll member and a non-orbiting scroll member disposed within the compressor housing. The orbiting scroll member and the non-orbiting scroll member each includes a baseplate and a wrap extending from the baseplate. The orbiting scroll member and the non-orbiting scroll member intermeshed to form a plurality of compression pockets. A driveshaft affixed to the orbiting scroll member configured to orbit the orbiting scroll member from a first orbital position to a second orbital position. A communication port disposed on the baseplate of one of the orbiting scroll member and the non-orbiting scroll such that, in the first orbital position, the communication port communicates with a first enclosed pocket of the plurality of compression pockets, and, in the second orbital position, the communication port communicates with a second enclosed pocket of the plurality of compression pockets.

In an embodiment, the orbiting scroll member has an intermediate orbital position between the first orbital position and the second orbital position, and during the intermediate orbital position, the communication port communicates with both the first enclosed pocket and the second enclosed pocket.

In an embodiment, the first enclosed pocket and the second enclosed pocket are adjacent in a radial direction and are separated by one of the wraps.

In an embodiment, the first enclosed pocket and the second enclosed pocket are at or about a same pressure during between the first orbital position and the second orbital position.

In an embodiment, a porous structure disposed in the communication port, the communication port configured to transfer fluid through the porous structure, and the porous structure configured to mitigate wear on a tip seal disposed on one of the wraps.

In an embodiment, the communication port is disposed within the baseplate of the non-orbiting scroll member.

In an embodiment, the compressor housing includes an intermediate pressure fluid port, the intermediate pressure fluid port is configured to receive working fluid from an intermediate pressure fluid source, the communication port is configured to receive the working fluid at an intermediate pressure and inject the working fluid into the first enclosed pocket and the second enclosed pocket.

In an embodiment, the compressor housing includes an intermediate pressure fluid port, the intermediate pressure fluid port is configured to discharge working fluid from both the first enclosed pocket and the second enclosed pocket, the communication port is configured to discharge the working fluid at an intermediate pressure.

In an embodiment, the communication port is configured to discharge the working fluid at the intermediate pressure to a suction inlet disposed on the housing.

BRIEF DESCRIPTION OF THE DRAWINGS

References are made to the accompanying drawings that form a part of this disclosure, and which illustrate embodiments in which the systems and methods described in this Specification can be practiced.

Like reference numbers represent like parts throughout.

DETAILED DESCRIPTION

This disclosure generally relates to a scroll compressor. More specifically, this disclosure relates to communicating intermediate pressure fluid with an asymmetric scroll compressor in a heating, ventilation, air conditioning, and refrigeration ("HVACR") system.

Figure 1:
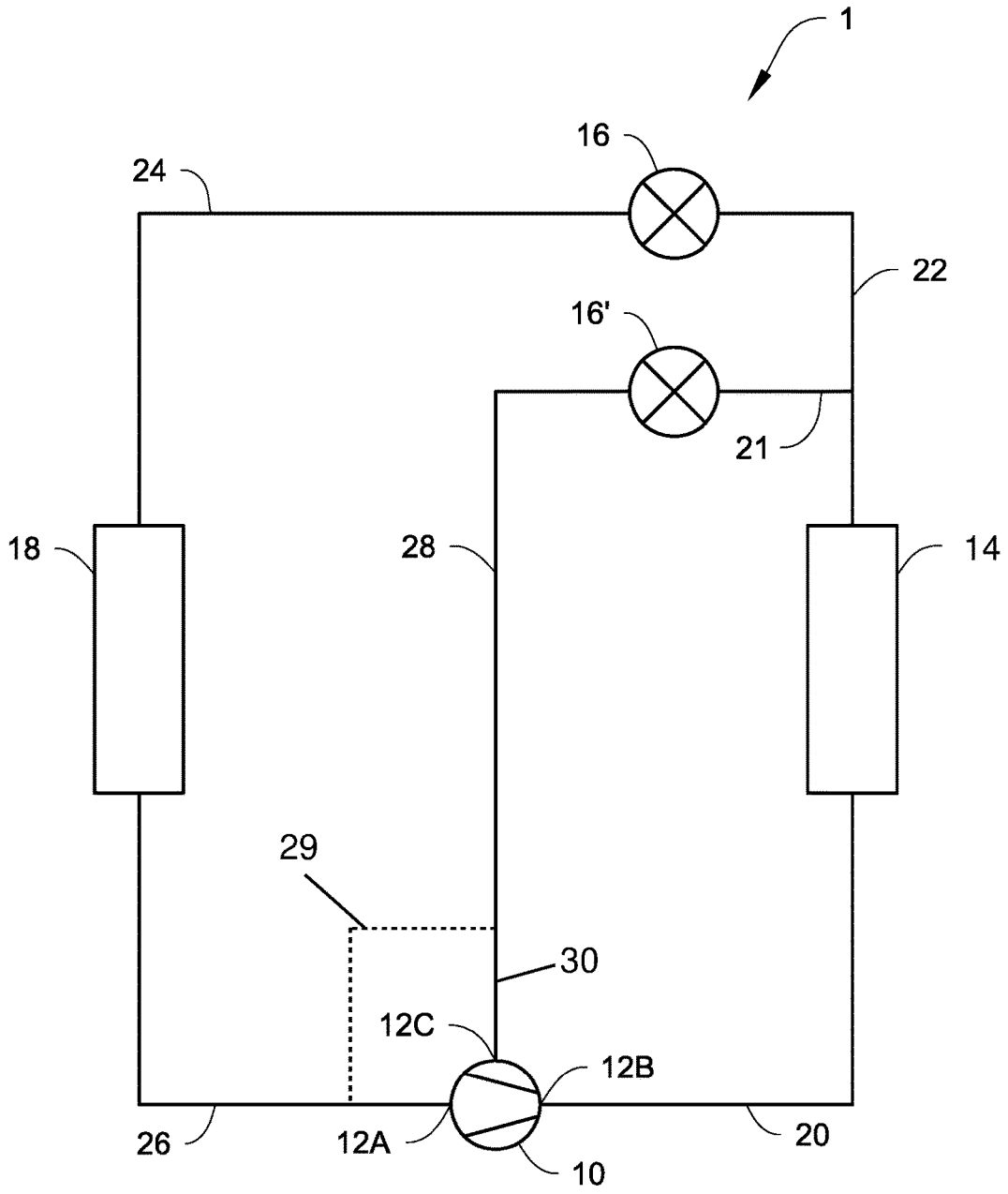
FIG. 1 is a schematic diagram of a refrigerant circuit, according to an embodiment.

FIG. 1 is a schematic diagram of a refrigerant circuit 1, according to an embodiment. The refrigerant circuit 1 includes a compressor 10, a condenser 14, a first expander 16, a second expander 16', and an evaporator 18.

It should be appreciated that the refrigerant circuit 1 is an exemplary embodiment and can be modified to include additional components or to remove components. In an embodiment, the refrigerant circuit 1 can include other components such as, but and not limited to, one or more flow control devices, economizers, receiver tanks, dryers, suction-liquid heat exchangers, or the like. In an embodiment, a refrigerant circuit 1 may be modified to have a single expander instead of two.

The refrigerant circuit 1 can be applied in a variety of systems used to control one or more environmental condition (e.g., temperature, humidity, air quality, or the like) in a space (generally referred to as a conditioned space). Examples of such systems include, but are not limited to, HVACR systems, transport climate control systems, or the like. Examples of a conditioned space include, but and not limited to, a portion of a home, building, an environmentally controlled container on a vehicle, ship, or vessel, or the like. In an embodiment, the refrigerant circuit 1 can be configured to be a cooling system (e.g., an air conditioning system) capable of operating in a cooling mode. In another embodiment, the refrigerant circuit 1 can be configured to be a heat pump system that can operate in both a cooling mode and a heating/defrost mode.

The refrigerant circuit 1 includes the compressor 10, the condenser 14, the first expander 16, the second expander 16', and the evaporator 18 that are fluidly connected via refrigerant lines 20, 21, 22, 23, 24, 26, 28, 29 and/or 30. In an embodiment, the refrigerant lines 20, 21, 22, 23, 24, 26, 28, 29 and/or 30 may alternatively be referred to as refrigerant conduits.

The compressor 10 includes a suction inlet 12A, a discharge outlet 12B, and intermediate pressure fluid port 12C. Port 12C may be referred to as an intermediate port. In operation, the compressor 10 compresses a working fluid (e.g., a working fluid such as a refrigerant, refrigerant mixture, or the like) from a relatively lower pressure gas (e.g., suction pressure) to a relatively higher pressure gas (e.g., discharge pressure). Relatively lower pressure working fluid is suctioned or displaced into the compressor 10 through the suction inlet 12A. The working fluid is then compressed within the compressor 10 and discharged at the relatively higher pressure from the compressor 10 at the discharge outlet 12B. In an embodiment, the compressor 10 is an asymmetric scroll compressor.

The relatively higher-pressure working fluid discharged from the discharge outlet 12B of the compressor 10 is also at a relatively higher temperature. In an embodiment, the relatively higher-pressure working fluid is a gas. The relatively higher-pressure working fluid flows from the compressor 10 through refrigerant line 20 to the condenser 14. The working fluid flows through the condenser 14 and rejects heat to a first process fluid (e.g., water, air, etc.). The cooled working fluid, which is now liquid or mostly liquid, flows to the first expander 16 via the refrigerant line 22 and to the second expander 16' via the refrigerant line 21. In an embodiment, an expander (e.g., first expander 16, second expander 16') may be an expansion valve, expansion plate, expansion vessel, orifice, or other such types of expansion mechanisms. It is to be appreciated that an expander in an embodiment may be any type of expander used in the field of HVACR for expanding working fluid that causes the working fluid to decrease in temperature.

A first portion of the cooled working fluid flows from the condenser 14 to the first expander 16 via the refrigerant line 22. The first expander 16 allows the working fluid to expand and reduces the pressure of the working fluid to obtain working fluid a liquid form, a gaseous form, or a combination thereof. The working fluid now has a lower temperature after being expanded by the first expander 16. This reduced pressure can be at an intermediate pressure that is higher than the suction pressure but lower than the discharge pressure of the compressor 10. As a result, the working fluid discharged from the first expander 16 can be in a liquid form, a gaseous form, or a combination thereof. The working fluid discharged from the first expander 16 flows to the evaporator 18 and absorbs heat from a second process fluid (e.g., water, air, etc.), heating the working fluid, and converts the working fluid to a gaseous or a mostly gaseous form. The gaseous working fluid then returns to the compressor 10 via the refrigerant line 26.

A second portion of the cooled working fluid flows from the condenser 14 to the second expander 16' via the refrigerant line 21. After passing through the second expander 16', the portion of the cooled working fluid can flow to the compressor 10 via the refrigerant lines 28 and 30. This portion can be fed into the compressor 10 at an intermediate pressure fluid port 12C to be injected into a compression chamber of the compressor 10. The above-described process continues while the refrigerant circuit 1 is operating, for example, in a cooling mode (e.g., while the compressor 10 is in operation).

In an embodiment, the intermediate pressure fluid port 12C can be configured to be an outlet port, with the refrigerant lines 28, 21 and the second expander 16' disconnected, for example, by removal or fluid control device(s), such as one or more flow control valves. Alternatively, the second expander 16' may be closed. Accordingly, the second portion of the cooled working fluid flows from the condenser 14 will flow from the condenser 14 to the first expander 16, like the first portion. The intermediate pressure fluid port 12C is configured to discharge a working fluid at an intermediate pressure to the refrigerant lines 30, 29. The working fluid discharged from the intermediate pressure fluid outlet 12C combines with the working fluid in the refrigerant line 26, to be fed into the compressor 10 from the suction inlet 12A. By discharging a portion of the working fluid in the compressor 10 at the intermediate pressure, the compression capacity of the compressor 10 can be controlled, conserving energy consumption of the compressor 10. The intermediate pressure fluid port 12C, functioning as an inlet port and/or an outlet port, can be collectively referred to as a communication port 12C.

It is appreciated that the communication port 12C can be configured as an inlet or outlet port by reconfiguring the refrigerant line(s) connected to the compressor 100 without mechanical alternating the communication port 12C. Accordingly, the description about the "intermediate pressure fluid inlet/outlet port", "intermediate pressure fluid port", "communication port", or "injection port" should be interpreted as a port capable of injecting or discharging. In an embodiment, any fluid described as, for example, injecting into, via, through the communication port, the injection term, process, function, action, or the like, should be interpreted as the fluid being capable of entering or exiting the communication port, depending on external configurations.

Figure 2:
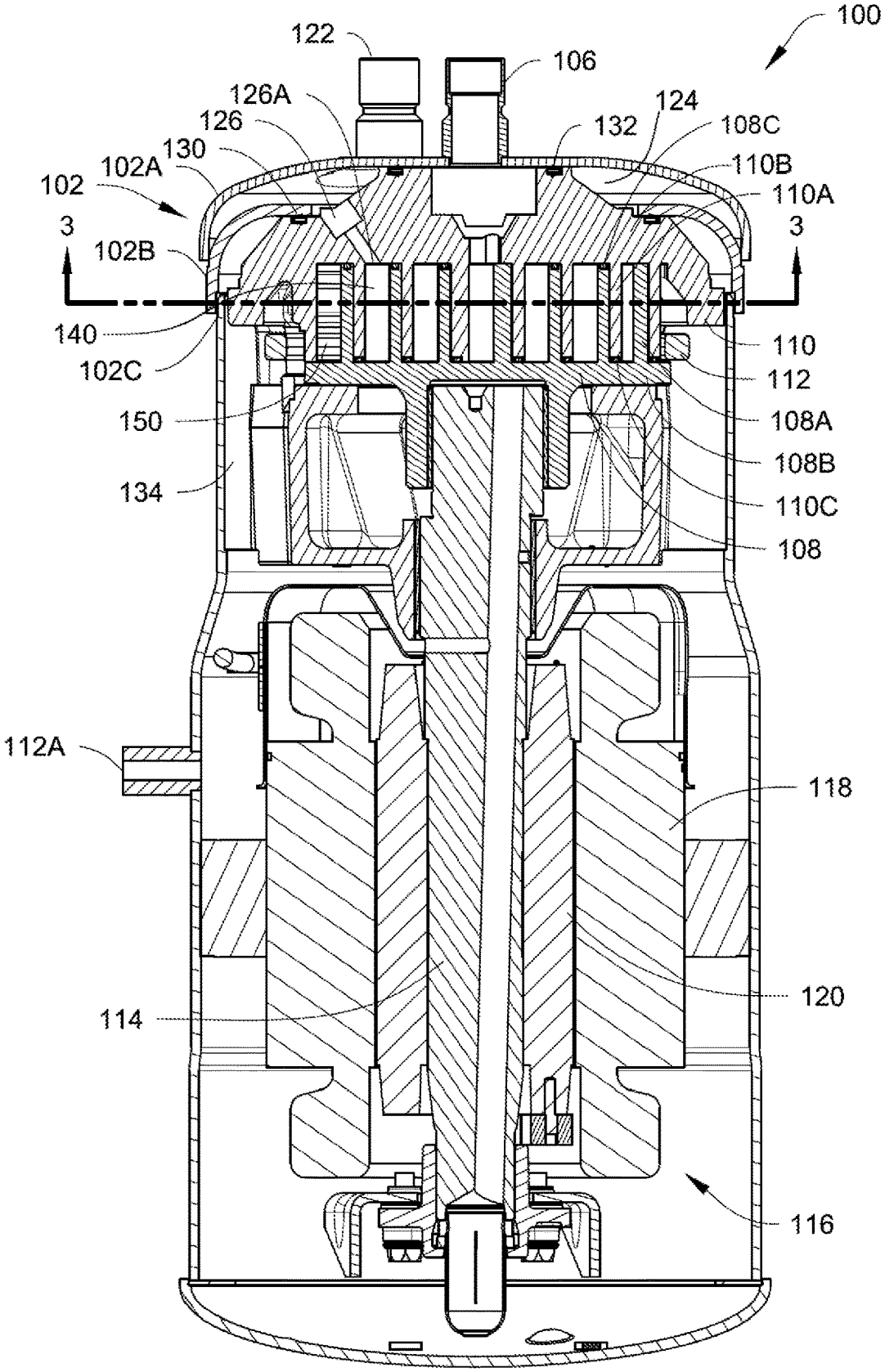
FIG. 2 is a cross-sectional view of a compressor, according to an embodiment.

FIG. 2 is a cross-sectional view of a compressor 100, according to an embodiment. The compressor 100 can be used in the refrigerant circuit 1 (shown in FIG. 1) as the compressor 10. It is to be appreciated that the compressor 100 can include additional features that are not described in detail in this Specification. For example, the compressor 100 in an embodiment can include a lubricant sump for storing lubricant to be introduced to the moving features of the compressor 100.

The illustrated compressor 100 is a single-stage scroll compressor. More specifically, the illustrated compressor 100 is a single-stage vertical scroll compressor. It is to be appreciated that the principles described in this Specification are not intended to be limited to single-stage scroll compressors and that they can be applied to multi-stage scroll compressors having two or more compression stages. Embodiments described herein with respect to a vertical compressor with a vertical or a near vertical crankshaft (e.g., crankshaft 114). However, it is to be appreciated that features described herein may also be applied to compressors having a crankshaft at a different orientation (e.g., a horizontal compressor).

FIG. 2 illustrates a vertical sectional side view of the compressor 100, according to one embodiment. The compressor 100 includes a housing 102. The housing 102 includes an upper portion 102A, an intermediate portion 102B, and a lower portion 102C. The upper portion 102A of the housing 102 is an outermost housing of the compressor 100 and can alternatively be referred to as the outer cap 102A. The intermediate portion 102B of the housing 102 is disposed between a compression chamber 140 and the upper portion 102A of the housing 102, and can be referred to as the intermediate cap 102B. The intermediate portion 102B and the upper portion 102A form a volume therebetween, which is the intermediate pressure chamber 124. The lower portion 102C provides the remainder of the housing 102 for the compressor 100. It is appreciated that the intermediate pressure chamber can be disposed on other part of the compressor 100. For example, other embodiments can provide an intermediate pressure chamber in a non-orbiting scroll member 110 or in an upper portion of the housing 102.

The compressor 100 includes a suction inlet 112A and a discharge outlet 106. The suction inlet 112A generally protrudes out from the compressor housing to accept a conduit (e.g., refrigerant line 26 in FIG. 1, or the like)

providing working fluid at a relatively low pressure (e.g., a suction pressure) into the compressor 100. In the illustrated embodiment, the discharge outlet 106 is oriented in line with a driveshaft 114 of the compressor 100. In the illustrated embodiment, the discharge outlet 106 is therefore oriented such that working fluid is discharged vertically upward (with respect to the page). It is to be appreciated that the discharge outlet 106 may have a different orientation (e.g., horizontal, angled, or the like) in other embodiments.

The compressor 100 includes an orbiting scroll member 108 and a non-orbiting scroll member 110. The non-orbiting scroll member 110 can alternatively be referred to as, for example, a stationary scroll, a fixed scroll, or the like. The non-orbiting scroll member 110 and the orbiting scroll member 108 are in intermeshing arrangement. In some embodiments, the non-orbiting scroll member 110 and the orbiting scroll member 108 may be held in an intermeshing arrangement by an Oldham coupling 112. Each of the orbiting scroll member 108 and the non-orbiting scroll member 110 includes a respective wrap 108A, 110A protruding from a respective baseplate 108B, 110B. In some embodiments, a tip seal 108C, 1100 can be disposed respectively on a distal end of each of the wraps 108A, 110A to seal between compression pockets on adjacent sides of each wrap 108A, 108A. In some embodiments, the orbiting scroll member 108 and/or the non-orbiting scroll member 110 can seal against an opposing surface without a discrete tip seal. For example, a feature protruding from a distal end of each of wraps of scroll members can be formed with the same material of the wraps. The feature protruding from the distal end can seal between compression pockets on adjacent sides of each wrap.

The compressor 100 includes the driveshaft 114. The driveshaft 114 can alternatively be referred to as a crankshaft. The driveshaft 114 is rotated by, for example, an electric motor 116. The electric motor 116 can generally include a stator 118 and a rotor 120. In an embodiment, the driveshaft 114 is affixed to the rotor 120 such that the driveshaft 114 rotates with the rotation of the rotor 120. The electric motor 116, stator 118, and rotor 120 operate according to generally known principles. The driveshaft 114 can, for example, be fixed to the rotor 120 via an interference fit or the like. In another embodiment, the driveshaft 114 may be connected to and rotated by an external electric motor, an internal combustion engine (e.g., a diesel engine or a gasoline engine), or the like. It is appreciated that in such embodiments the electric motor 116, stator 118, and rotor 120 would not be present within the housing 102 of the compressor 100.

The orbiting scroll member 108 is affixed to the end of the drive shaft 114. The driveshaft 114 rotates continuously during compressor operation causing the orbiting scroll member 108 to orbit relative to the non-orbiting scroll member 110 of the compressor 100. The orbiting motion intermeshes the orbiting scroll member 108 and the non-orbiting scroll member 110 to form a plurality of compression pockets that are separated by a wrap 108A or 110A and its tip seal 108C or 110C of the orbiting scroll member 108 or the non-orbiting member 110. It is appreciated that the compression pockets are enclosed pockets containing working fluid. The compression pockets are disposed between and enclosed by the orbiting scroll member 108 and the non-orbiting scroll members 110. It is further appreciated that compression pockets are a number of volumes being compressed within the compression chamber 140. The compression chamber 140 occupies a volume between the orbiting and the non-orbiting scroll members 108, 110 fluidly connected to a suction inlet 112A and the discharge outlet 106 of the compressor 100. In an embodiment, the compression chamber 140 includes a suction intake as further described below.

The compressor 100 includes an intermediate pressure fluid port 122. The intermediate pressure fluid port 122 is disposed in the upper portion 102A of the housing 102. The intermediate pressure fluid port 122 is configured to be fluidly connected to an intermediate pressure fluid source, such as an economizer and/or an expander (e.g., the expander 16'). In an embodiment, the intermediate pressure fluid port 122, the suction inlet 112A and the discharge outlet 106 can be tubular machined connections or ports that are welded to the housing 102. In an embodiment, the housing 102, the intermediate pressure fluid port 122, the suction inlet 112A and the discharge outlet 106 can be a single piece, unitary construction. For example, an economizer can be included in the refrigerant circuit 1 and configured to exchange thermal energy between refrigerant lines 28 and 22.

The intermediate pressure fluid port 122 is in fluid communication with an intermediate pressure chamber 124 and configured to communicate (e.g., supply or discharge) intermediate pressure working fluid with the intermediate pressure chamber 124. The intermediate pressure chamber 124 is fluidly connected to the compression chamber 140 via a communication port 126. It is appreciated that the communication port can be referred to as an injection port 126 when the injection port 126 is configured to inject or supply working fluid at an intermediate pressure into the compressor 100. In an embodiment, more than one communication ports can connect the intermediate pressure chamber 124 with the compression chamber 140.

In the illustrated embodiment, the communication port 126 is formed in the non-orbiting scroll member 110 of the compressor 100. Working fluid that has been compressed in the compression chamber 140 is provided from the compressor 100 via the discharge outlet 106. The compressed working fluid (e.g., at a discharge pressure) is then provided to the condenser (e.g., condenser 14 via refrigerant line 20 in FIG. 1).

A discharge seal 132 (e.g., a gasket, O-ring, face seal, or the like) and an intermediate seal 130 (e.g., a gasket, O-ring, face seal, or the like) can function to isolate the intermediate pressure chamber 124 from the discharge outlet 106 (e.g., working fluid at a discharge pressure) and a suction chamber 134 (e.g., working fluid at a suction pressure). The discharge seal 132 sealingly engages the upper portion 102A of the housing 102 and the non-orbiting scroll member 110. The intermediate seal 130 sealingly engages the intermediate portion 102B of the housing 102 and the non-orbiting scroll member 110.

In operation, the compressor 100 can communicate (e.g., receive or supply) working fluid at an intermediate pressure via the intermediate pressure fluid port 122. In an embodiment, the intermediate pressure fluid port 122 supplies the working fluid at or about the intermediate pressure to the compression chamber 140 via the injection port 126, where the working fluid is compressed and ultimately discharged via the discharge outlet 106. In another embodiment, the intermediate pressure fluid port 122 receives the working fluid at or about the intermediate pressure from the compression chamber 140 via the communication port 126. The working fluid at the intermediate pressure is supplied, for example, via refrigerant line 29, back to the suction inlet 112A. In the illustrated embodiment, the refrigerant line 29 is external to the compressor 100 (e.g., see FIG. 1). However, it should be appreciated that the refrigerant line 29 may be internal to the compressor 100 in an embodiment. (e.g., a passageway connecting the intermediate pressure chamber 124 to the suction chamber 134, or the like). In yet another embodiment, the intermediate pressure fluid port 122 receives the working fluid at or about the intermediate pressure from the compression chamber 140 via the communication port 126. The working fluid at the intermediate pressure is supplied, for example, via refrigerant line 20, to a condenser (e.g., the condenser 14 of FIG. 1).

In an embodiment, to ensure that working fluid is flowing into the compression chamber 140 via the injection port 126, and not outward, the working fluid at the injection port 126 (e.g., the intermediate pressure fluid) may generally have a higher pressure than the pressure of the working fluid in the compression chamber 140 at the location of the injection port 126. In an embodiment, because pressure of the compression chamber 140 is cyclic in a scroll compressor, the pressure of the compression chamber 140 at the location of the injection port 126 may briefly be less than the pressure of the working fluid at the injection port 126. However, the intermediate pressure chamber 124 may reduce an impact of any pressure wave that could flow backwards from the normal flow direction. In an embodiment, a one-way valve (not shown, e.g., a check valve) could be included to ensure that working fluid cannot flow backwards from the normal flow direction. The specific location of the injection port 126 with respect to the compression process can be varied.

In an embodiment, the location of the communication port 126 can be selected so that the pressure in the compression chamber 140 is between the suction pressure and the discharge pressure. The communication port 126 can be bored or otherwise drilled or formed in the non-orbiting scroll member 110 of the compressor 100. In an embodiment, the non-orbiting scroll member 110 can be cast or otherwise manufactured to include the communication port 126. A communication port outlet 126A connects the communication port 126 to the compression chamber 140. In an embodiment, the communication port 126 can be bored or otherwise drilled or formed in the orbiting scroll member 108 of the compressor 100.

As discussed above, the driveshaft 114 is affixed to the orbiting scroll member 108 and rotates to drive and orbit the orbiting scroll member 108. As the driveshaft 114 rotates, the orbiting scroll member 108 orbits relative the non-orbiting scroll member 110. The relative rotational position of the driveshaft 114 corresponds to the relative orbital position of the orbiting scroll member 108 relative to the non-orbiting scroll member 110. This relative rotational position of the crankshaft 114 can also be referred to as the crank angle. The corresponding orbital position of the orbiting scroll member 108 can be an orbital position corresponding to a crank angle. The crank angle can be the amount of rotation (e.g., X degrees or X°) of the crankshaft 114 from a reference rotational position (e.g., a starting rotational position, or 0°). The orbital position of the orbiting scroll member 108 is defined by the corresponding crank angle. For example, the orbiting scroll member 108 can have a starting position at or about 0° crank angle. The orbital position of orbiting scroll member 108 will be 0°. "About" a certain degree (e.g., about 180°) can include a range above or below the certain degree (e.g., 180°) due to variants from manufacturing variations or tolerance, from normal wear and tear during operation, or the like.

Figure 3A:
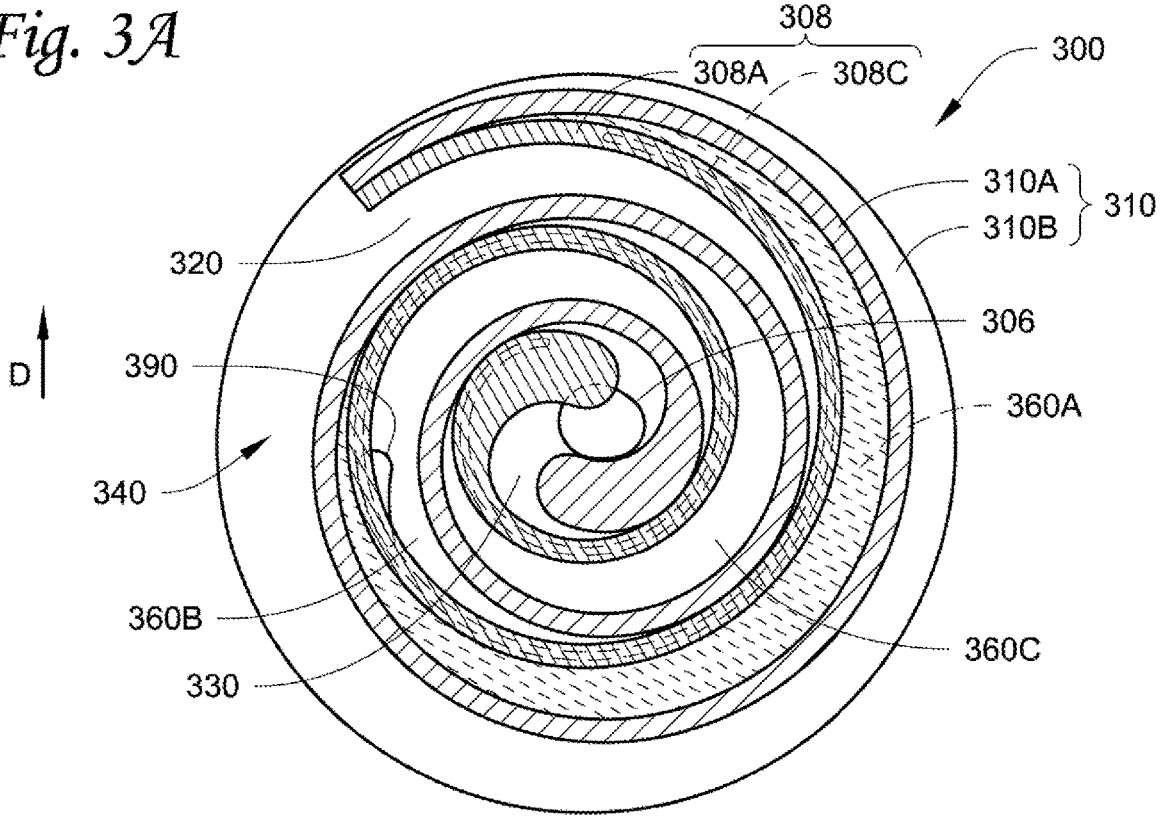
FIG. 3A is a cross-sectional view of a pair of scrolls of an asymmetric scroll compressor, according to an embodiment.
Figure 3B:
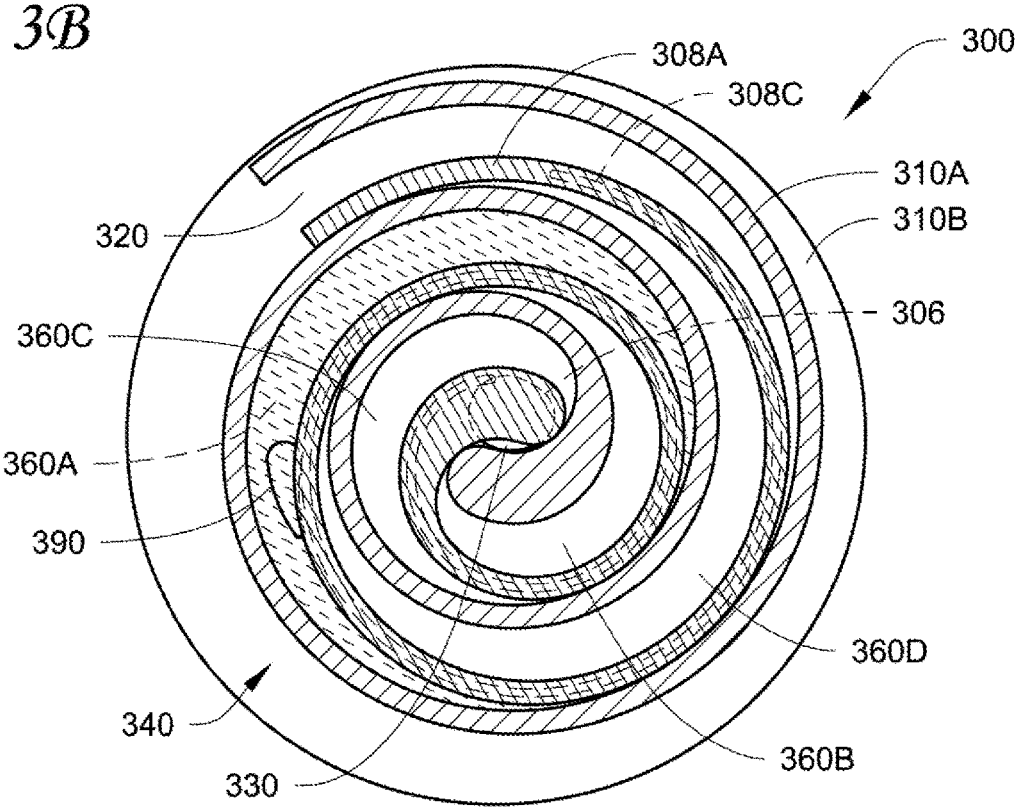
FIG. 3B is another cross-sectional view of the pair of scrolls of FIG. 3A, during a different orbital position.
Figure 3C:
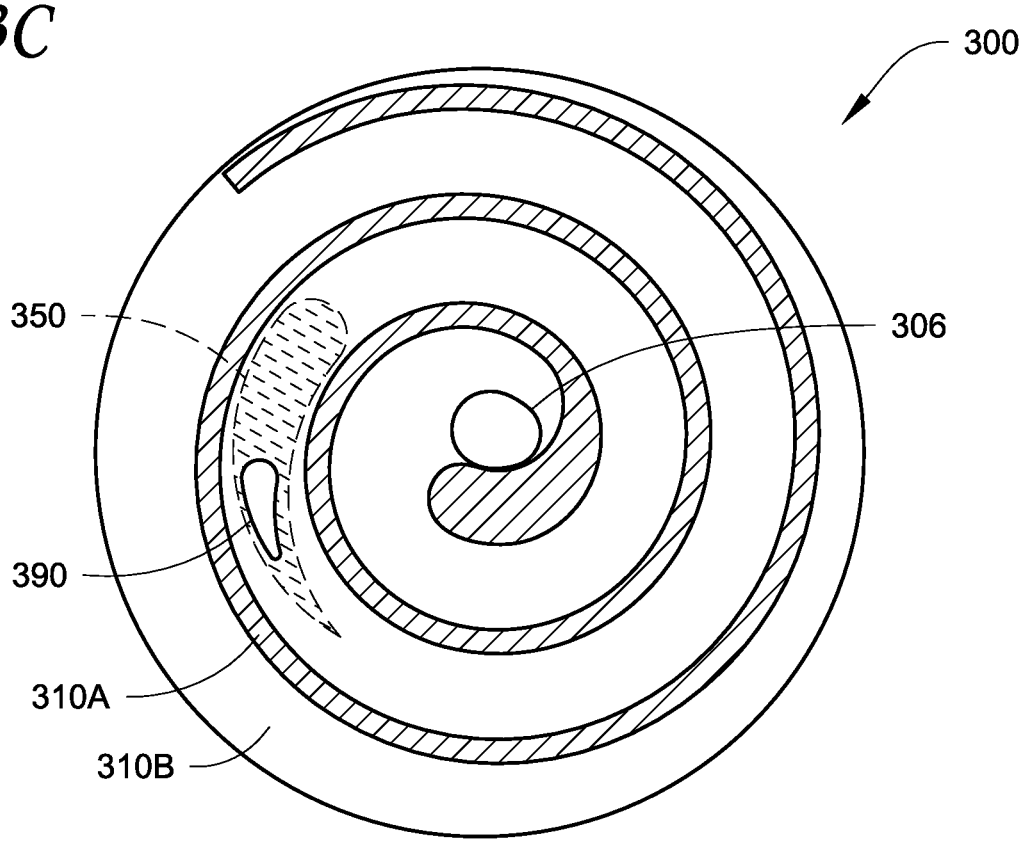
FIG. 3C is another cross-sectional view of the pair of scrolls of FIG. 3A, in which one of the scrolls are omitted.

FIGS. 3A to 3C show a porting envelope 350 (shown in FIG. 3C) that is defined by an overlapping area from relative orbital movements of two adjacent compression pockets compressed by a non-orbiting scroll member and an orbiting scroll member of an asymmetric scroll compressor. FIGS. 3A to 3C can be a cross-sectional view along a line 3-3 (shown in FIG. 2) of a pair of scrolls (e.g., the non-orbiting scroll member 110 and the orbiting scroll member 108) of an asymmetrical scroll compressor 300, according to an embodiment. For example, the asymmetric scroll compressor 300 includes an orbiting scroll member 308 and a non-orbiting scroll member 310 intermeshing to form a plurality of compression pockets 360A-D. The asymmetric scroll compressor 300 can include, for example, a suction inlet, a discharge port 306, and a communication port outlet of a communication port 390 configured to communicate working fluid at an intermediate pressure with a compression chamber, similar to the compressor 100 in FIG. 2. The cross-sectional view in FIG. 3A can be along the line 3-3 in FIG. 2.

In the illustrated embodiment of FIGS. 3A to 3C, the compressor 300 includes a non-orbiting scroll member 310 including a wrap 310A, a baseplate 310B, and a tip seal (not shown an orbiting scroll member 308 (not shown in FIG. 3C) including a wrap 308A, a baseplate (not shown) and a tip seal (e.g., tip seal 308C), a suction intake 320, and a discharge outlet 306. The baseplate of the orbiting scroll member 308 is omitted in these views. The non-orbiting scroll member includes the wrap 310A protruding from the baseplate 310B. In an embodiment, the non-orbiting scroll member 310, the orbiting scroll member 308, and the discharge outlet 306 can be the non-orbiting scroll member 110, the orbiting scroll member 108, and the discharge outlet 106 as in FIG. 2. The discharge outlet 306 is disposed in the non-orbiting member. In an embodiment, the discharge outlet 306 can be the discharge outlet 106 of the compressor 100 in FIG. 2.

The compression chamber 340 includes the suction intake 320 at an entrance of the compression chamber 340 accepting working fluid at a suction pressure. The suction intake 320 fluidly connects to a suction inlet (not shown) similar to the suction inlet 112A of FIG. 2. The compression chamber 340 further includes a compression chamber output 330 at an exit of the compression chamber 340 discharging the working fluid at a discharge pressure to the discharge port 306. The suction intake 320 connects the compression chamber 340 to a suction chamber (not shown) of the compressor 300. In an embodiment, the suction chamber can be the suction chamber 134 in FIG. 2. The compression chamber output 330 connects the compression chamber 340 to the discharge port 306. In an embodiment, the discharge port 306 can be the discharge port 106 in FIG. 2.

A tip seal 308C is disposed on a distal end of the wrap 308A of the orbiting scroll member. The tip seal 308C can be the tip seal 110C in FIG. 2. The tip seal 308C on the wrap 308A is disposed between the distal end of the wrap 308A and the baseplate 310B of the non-orbiting member to seal the compression pockets 360A-C from one another.

FIG. 3A is a cross-sectional view of a pair of scrolls 308, 310 of an asymmetric scroll compressor 300, according to an embodiment. FIG. 3A shows the compressor 300 (e.g., the wrap 308A of the orbiting scroll member 308) at an orbital position. For example, the orbital position can correspond to a crank angle at the reference crank angle (e.g., 00). FIG. 3B is a cross-sectional view of the pair of scrolls 308, 310 of FIG. 3A at another orbital position, according to an embodiment. In an embodiment, the other orbital position can be at or about 180° from the orbital position of FIG. 3A (e.g., at or about 180° counter-clockwise or clockwise from the orbital position of FIG. 3A).

As shown in FIG. 3B, the wrap 308A orbited from the orbital position (alternatively referred to as a suction orbital position) of FIG. 3A to another orbital position in FIG. 3B. The orbital movement of the orbiting scroll member pushes working fluid at the suction intake 320 into an enclosed pocket, forming a compression pocket 360A. When moving from the orbital position of FIG. 3A to the orbital position of FIG. 3B, each compression pocket (e.g., 360B, 360C) in FIG. 3A is moved circumferentially and radially inward. Each compression pocket (e.g., 360B, 360C) also becomes smaller as it moves circumferentially and radially inward from the suction intake 320 to the compression chamber output 330 causing compression of the working fluid. The compressed working fluid in the compression chamber output 330 at FIG. 3A is then forced into the discharge outlet 306 at FIG. 3B.

FIG. 3C is a cross-sectional view of the pair of scrolls 308, 310 of FIG. 3A. The view of FIG. 3C omits the wrap 308A of the orbiting scroll member 308. The porting envelope 350 in FIG. 3C is an area on the baseplate 310B of the non-orbiting scroll member 310. This area of the porting envelope 350 switches from being within the compression pocket 360B in FIG. 3A to the compression pocket 360A in FIG. 3B such that an injection port 390 having an outlet within the porting envelope 350 can inject into each or both of the two adjacent compression pockets (i.e., compression pockets 360A, 360B) during certain orbital positions between the first orbital position of FIG. 3A and the second orbital position of FIG. 3B. Thus, the communication port 390 having the communication port outlet is shared between the two compression pockets 360A, 360B at one or more period of orbital positions between the orbital position of FIG. 3A and the orbital position of FIG. 3B.

Sharing of the communication port between adjacent compression pockets improves an asymmetric scroll compressor by increasing mass flow and/or increasing efficiency. In some embodiments, the shared communication port can be designed to optimize the performance of the compressor for its intended use (e.g., increased efficiency, increased mass flow, etc.). The communication port can be configured to communicate with the adjacent compression pockets while in a similar pressure range (e.g., pressure of first pocket in the first orbital position is at or about the same pressure as the second pocket ion the second orbital position). At or about the same pressure can be a range of pressure allowing the shared communication port to inject or discharge the intermediate fluid, while still improving the mass flow and/or efficiency of the compressor. A working fluid at the intermediate pressure can be injected or discharged through the shared communication port. By controlling a location of the shared injection port relative to the porting envelop, the designed mass flow into each of the two adjacent compression pockets can be controlled or adjusted. For example, the shared injection port can be configured to be centered biased to one of the two adjacent compression pockets for injecting more into the one compression pocket. In some embodiments, experimental data shows that a shared communication port within a porting envelope can improve compressor efficiency by 2%, which is a significant improvement in the technical field of scroll compressors. In the illustrated example of FIG. 3A to 3B, the orbiting scroll member orbits from the first orbital position at or about 0° crank angle to the second orbital position at or about 1800 crank angle. X° crank angle can be alternatively referred as X°.

Figure 4A:
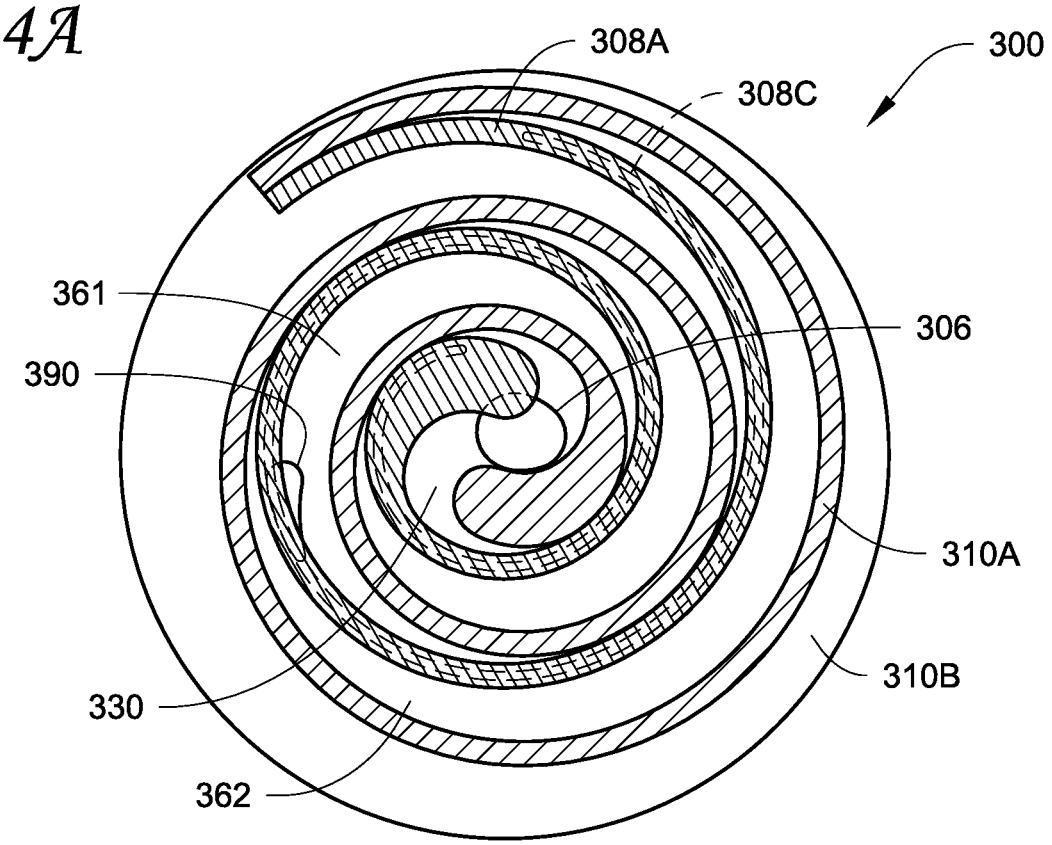
FIG. 4A is a cross-sectional view of the pair of scroll of FIG. 3A.

FIG. 4A is a cross-sectional view of the pair of scrolls of FIG. 3A at yet another orbital position, according to an embodiment. In an embodiment, the orbital position of FIG. 4A can be the same as the orbital position in FIG. 3A. In another embodiment, the orbital position can be further along (i.e., the orbital position of FIG. 4A is further away in a radial direction from a reference orbital position than the orbital position of FIG. 3A) than the orbital position of the scroll members 308, 310 of FIG. 3A.

As shown in FIG. 4A, the communication port 390 having a communication port outlet disposed in the porting envelope 350 (shown in FIG. 3C). In the illustrated embodiment, the communication port outlet of the communication port 390 has a comet shape. At the orbiting position of FIG. 4A, the communication port 390 communicates with a first compression pocket 361 and is not communicating with a second compression pocket 362 which is adjacent to the first compression pocket 361 in a radial direction. In illustrated example, the communication port 390 is partially blocked by the wrap 308A and the tip seal 308C of the orbiting scroll member. It is appreciated that the communication port outlet can be moved, reshaped, or resized to be communicating with the first compression pocket 361 without any blockages at the orbital position of FIG. 4A. It is further appreciated that the injection port 390 starts to communicate with the first compression pocket 361 at an earlier orbital position than the orbital position of FIG. 4A. The earlier position can be referred to as a starting orbital position of a communication cycle of the injection port 390.

Figure 4B:
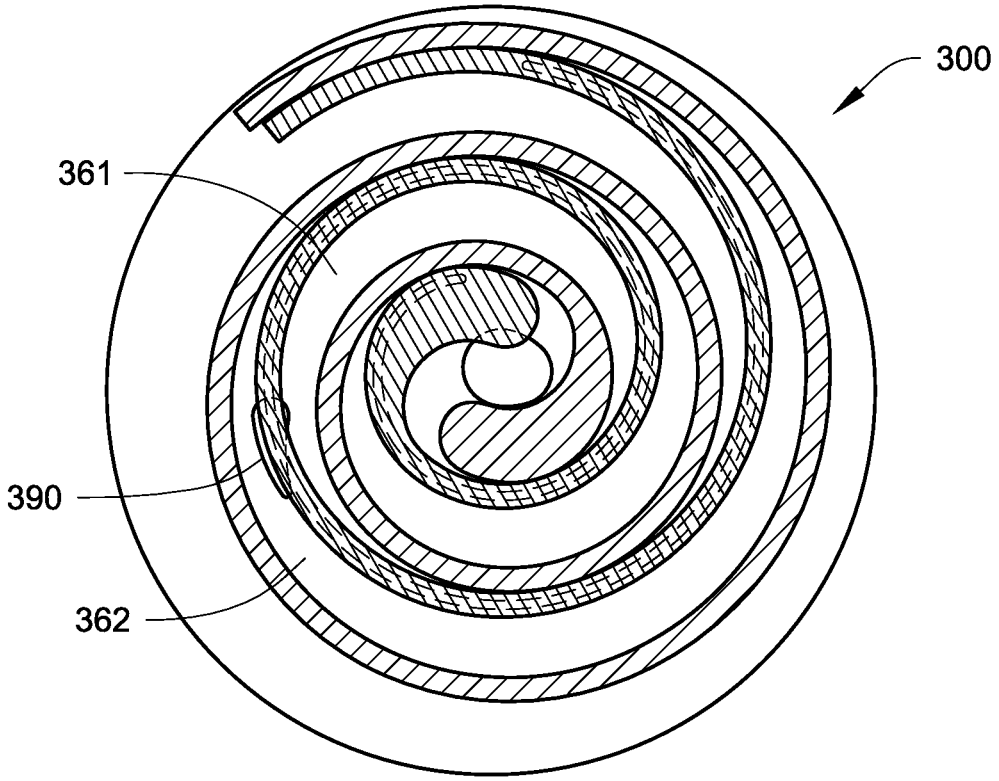
FIG. 4B is a cross-sectional view of the pair of scroll of FIG. 4A, in a different orbital position.

FIG. 4B is a cross-sectional view of the pair of scrolls 308, 310 of FIG. 3A at yet another orbital position, according to an embodiment. This orbital position, for example, can be half way between the orbital position of FIG. 3A and the orbital position of FIG. 3B. The communication port 390 is illustrated to be communicating with both the first compression chamber 361 and the second compression chamber 362. For example, the orbital position of FIG. 4B can be at or about 90°. It is appreciated that a starting orbital position of the injection port 390 begins to communicate with both compression pockets 361 and 362 is earlier than the orbital position of FIG. 4B. The starting orbital position of the injection port 390 begins to communicate with the both compression pockets 361 and 362 simultaneously can be referred to as a starting orbital position of a sharing portion of the communication cycle. In an embodiment, the sharing portion of the communication cycle can be orbital positions that allow the communication port to be communicating with both compression pockets simultaneously. An ending orbital position of the injection port 390 stops communicating with both compression pockets 361, 362 simultaneously can be referred to as an ending orbital position of the sharing portion of the communication cycle. It is appreciated that the ending position is further along from the fourth orbital position. In an embodiment, the communication cycle can be biased towards one of the two adjacent compression pockets over the other one, for example, by having a center of the injection port outlet disposed towards the one of the two adjacent compression pockets, providing a longer communication time with the one of the two adjacent compression pockets. A longer communication time can result in a larger volume of working fluid being communicated through the injection port during each communication cycle. In an embodiment, for an non-limiting example, the sharing portion of the communication cycle can be at or about 600 to at or about 120°. In some other embodiments, the sharing portion of the communication cycle can be at or about 180° to at or about 240°.

Figure 4C:
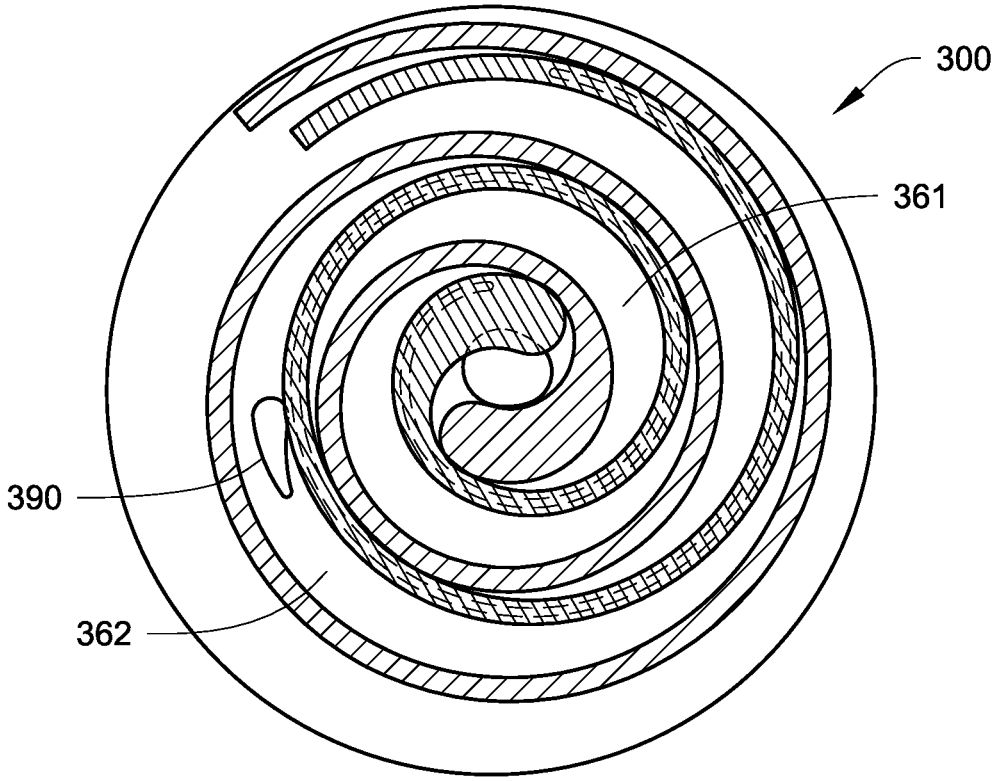
FIG. 4C is a cross-sectional view of the pair of scroll of FIG. 4B, in a different orbital position.

FIG. 4C is a cross-sectional view of the pair of scrolls FIG. 3A at yet another orbital position, according to an embodiment. The orbital position of FIG. 4C can be, for example, further along from the orbital positions of FIG. 4A and FIG. 4B. As shown in FIG. 4C, the injection port 390 communicates with the second compression pocket 362 without communication with the first compression pocket 361. It is appreciated that the orbital position of FIG. 4C, as illustrated, is further along or at about the ending orbital position of the sharing portion of the communication cycle.

A communication cycle can correspond to injection into, or communicate with, a first compression pocket (e.g., compression pocket 361, as illustrated in FIG. 4A), into both the first compression pocket and a second compression pocket (e.g., compression pockets 361, 362, as illustrated in FIG. 4B), and into the second compression pocket (e.g., compression pocket 362, as illustrated in FIG. 4C). In an embodiment, a portion of the communication cycle injecting into, or communicating with, a first compression pocket can be a first portion of the communication cycle. A portion of the communication cycle injecting into, or communicating with, a second compression pocket can be a second portion of the compression cycle. A portion of the communication cycle injecting into, or communicating with, both compression pockets simultaneously can be a sharing portion of the communication cycle. In an embodiment, for a non-limiting example, the first portion of the compression cycle can be at or about crank angle 0° to 60°; the sharing portion of the communication cycle can be at or about crank angle 60° to 120°; and the second portion of the compression cycle can be at or about 120° to 180°. In some other embodiments, for a non-limiting example, the first portion of the compression cycle can be at or about crank angle 600 to 180°; the sharing portion of the communication cycle can be at or about crank angle 1800 to 240°; and the second portion of the compression cycle can be at or about 240° to 360°. It is appreciated that the portions and sharing portion of the communication cycle can occupy the same or different amounts or portion of range of crank angles.

FIGS. 5A to 5E are cross-sectional views of a non-orbiting scroll member of an asymmetric scroll compressor, according to some embodiments. The cross-sectional view of FIGS. 5A to 5E can be a cross-sectional view along the line 3-3 (shown in FIG. 2) of the non-orbiting scroll member. As shown in FIG. 5A to 5E, compressor 500A to 500E can include same or similar components of the compressors in FIG. 2 to FIG. 4C.

Figure 5A:
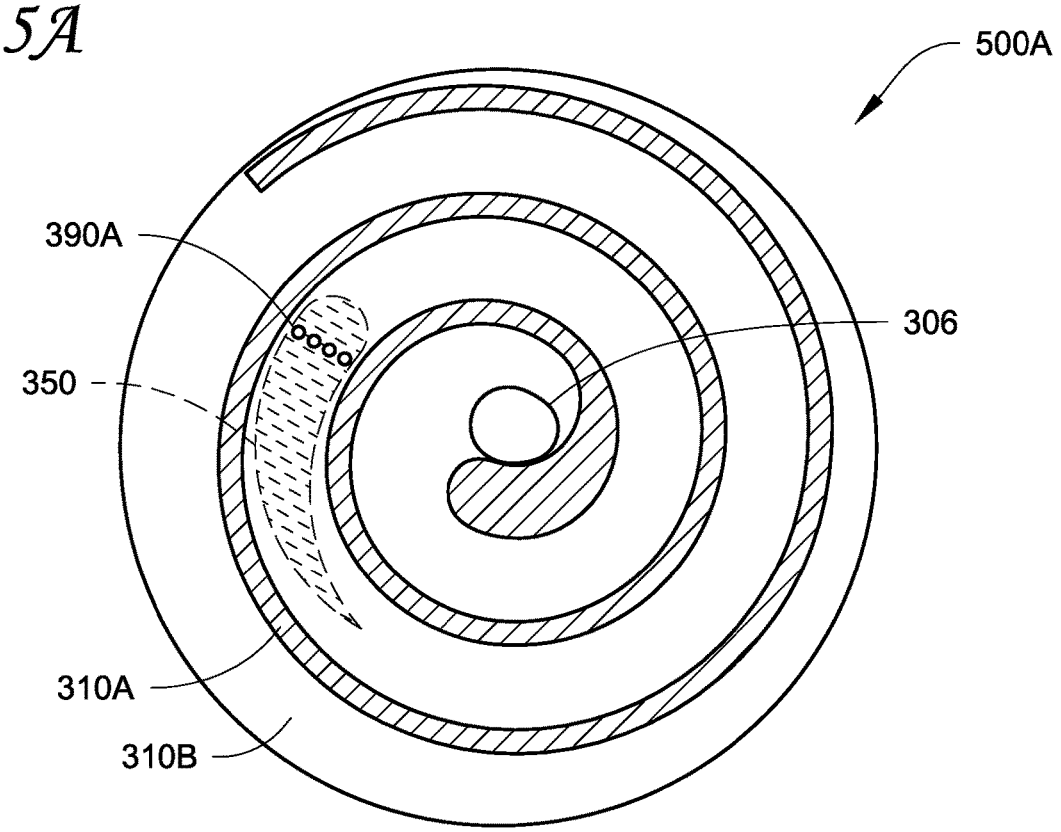
FIG. 5A is a cross-sectional view of a non-orbiting scroll member, according to another embodiment.
Figure 5B:
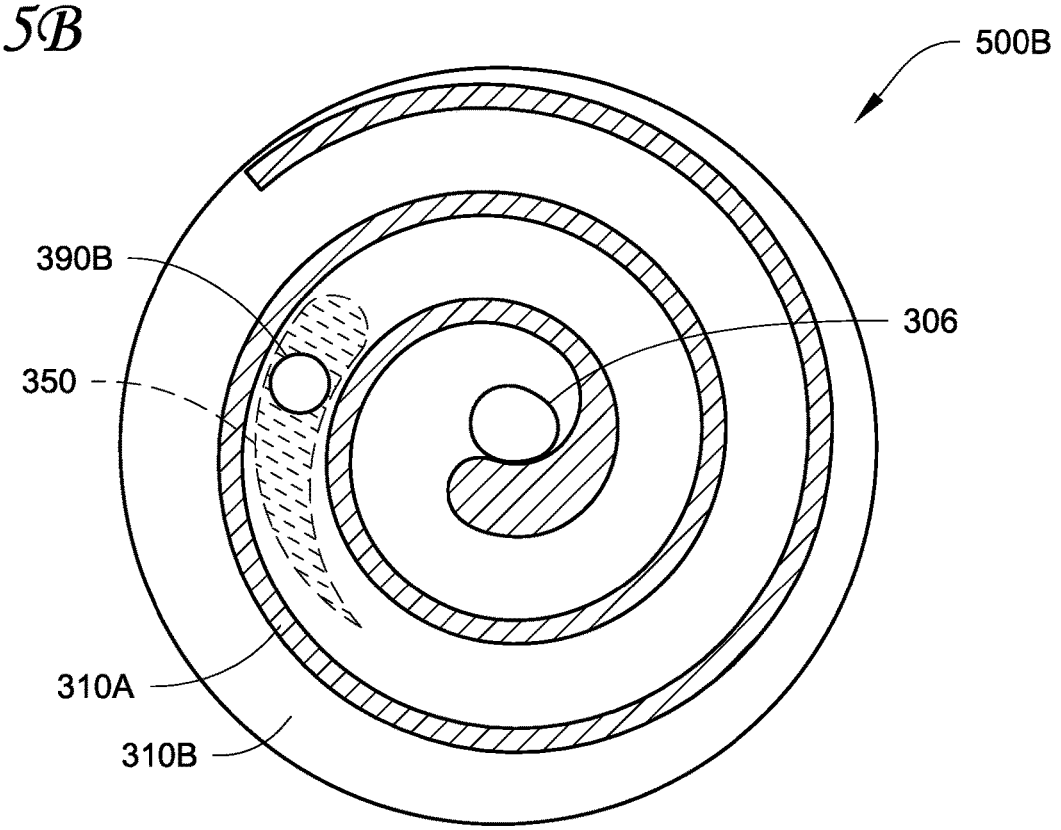
FIG. 5B is a cross-sectional view of a non-orbiting scroll member, according to yet another embodiment.
Figure 5C:
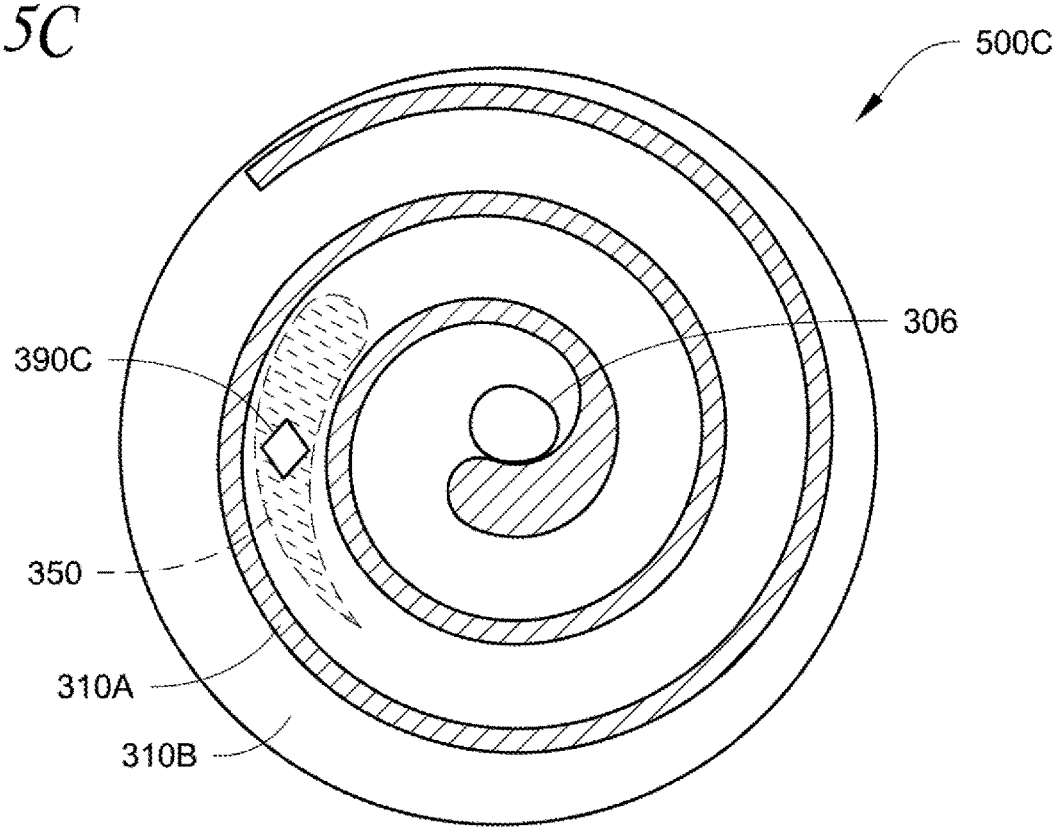
FIG. 5C is a cross-sectional view of a non-orbiting scroll member, according to yet another embodiment.
Figure 5D:
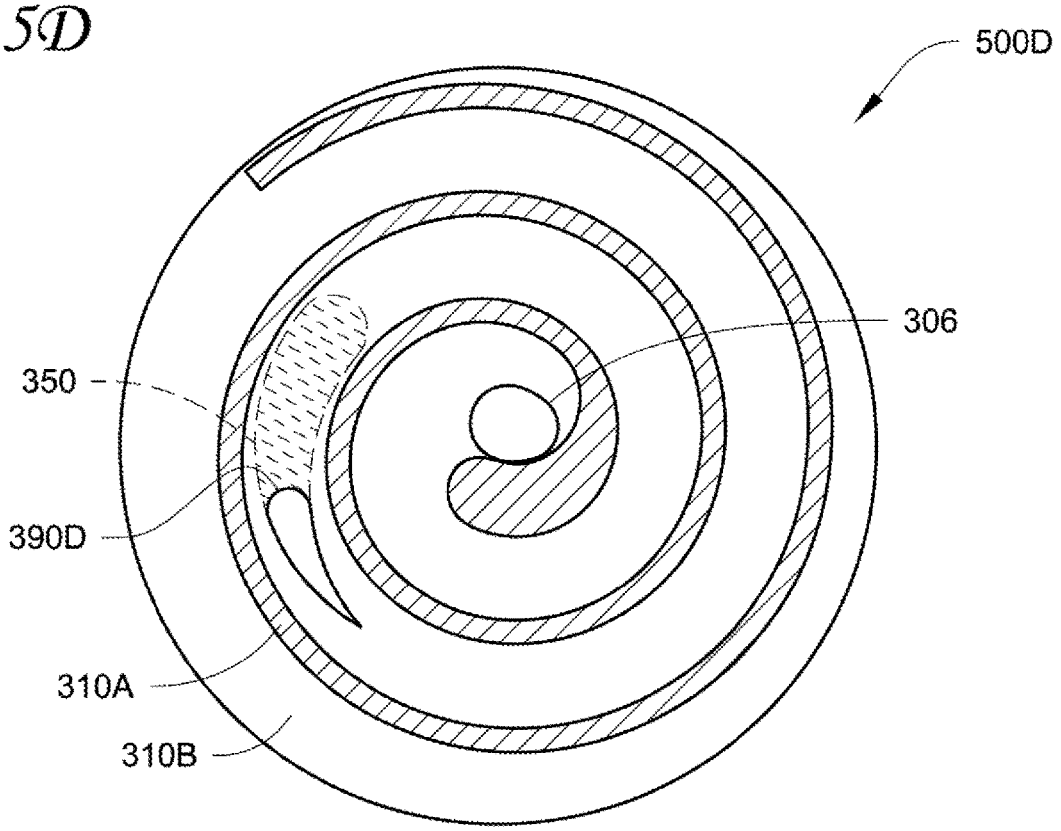
FIG. 5D is a cross-sectional view of a non-orbiting scroll member, according to yet another embodiment.

FIG. 5A is a cross-sectional view of a non-orbiting member of an asymmetric scroll compressor 500A, according to an embodiment. In the illustrated embodiment, the injection port outlet 390A is a plurality of circles. FIG. 5B is a cross-sectional view of a non-orbiting member of an asymmetric scroll compressor 500B, according to an embodiment. In the illustrated embodiment, the injection port outlet 390B is a circle. FIG. 5C is a cross-sectional view of a non-orbiting member of an asymmetric scroll compressor 500C, according to an embodiment. In the illustrated embodiment, the injection port outlet 390C is a diamond shape. FIG. 5D is a cross-sectional view of a non-orbiting member of an asymmetric scroll compressor 500D, according to an embodiment. In the illustrated embodiment, the injection port outlet 390D is a comet shape. It is appreciated that, FIGS. 5A-D are some exemplary shape of a communication port outlet. In some embodiment, the communication port outlet can have combinations and/or modifications of the illustrated shapes as shown in FIGS. 5A-D. For example, the communication port outlet in an embodiment can have a shape as described in which any corners of the shape are modified to be rounded. In an embodiment, the communication port outlet can have a non-circular shape and/or non-oval shape.

Figure 5E:
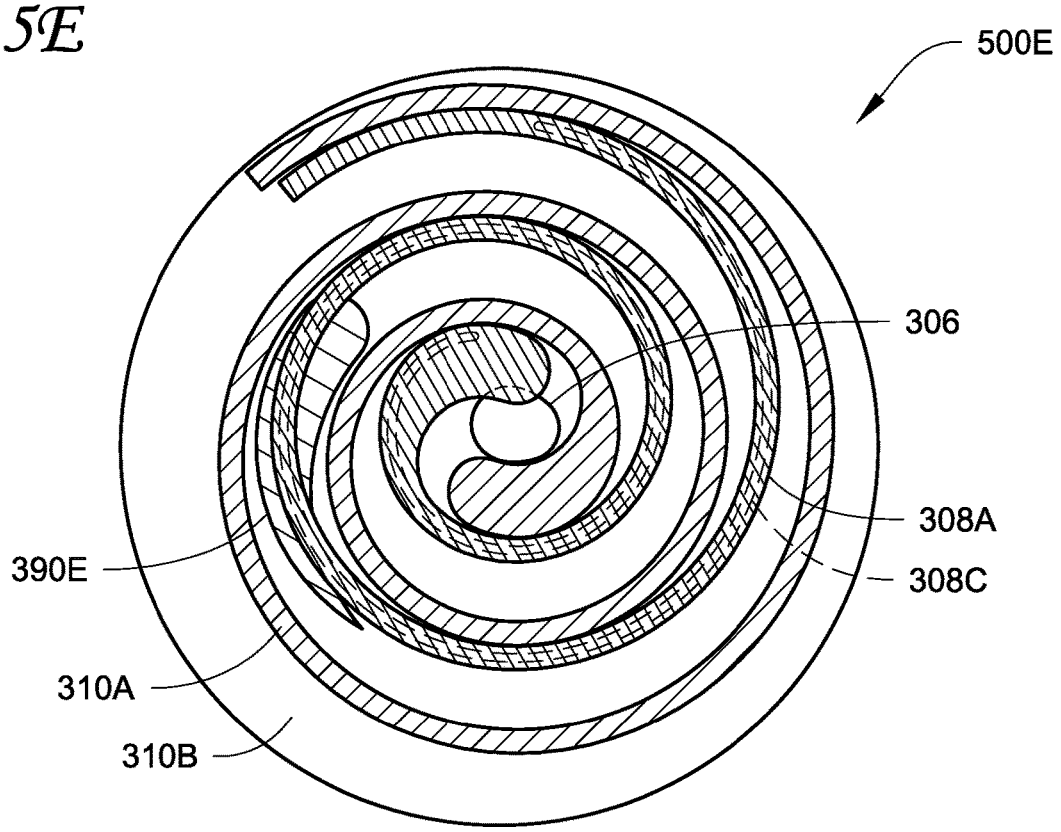
FIG. 5E is a cross-sectional view of a non-orbiting scroll member, according to yet another embodiment.

FIG. 5E is a cross-sectional view of a non-orbiting member of an asymmetric scroll compressor 500E, according to an embodiment. In the illustrated embodiment, an injection port outlet 390E fills the porting envelope 350 (shown in FIG. 3C). The injection port behind the injection port outlet 390 is at least partially filled with a porous material and allowing working fluid injection through the injection port. By having a porous material, the tip seal (not shown) can glide over the porous material and have less wear and tear from cutting against large or sharp edges created by an open injection port and extending the lifespan of the tip seal (not shown). The tip seal can be, for example, the tip seal 308C or 108C in FIG. 2 and FIGS. 4A to 4C. It is appreciated that the injection port outlet 390E can be any of the shapes as shown and described in FIGS. 5A-D and does not need to fill the entire porting envelope 350. In an embodiment, the injection port outlet 390E can have other shapes, for example, but not limited to, the shape of the outlet 390E segmented into a plurality of portions, the shapes disclosed in FIGS. 5A-D for injection port outlets 390A-E, combinations and/or modifications of the shapes disclosed in FIGS. 5A-D for injection port outlets 390A-E, and the like.

In another embodiment, one or more supporting structures can be disposed over the injection port outlets 390A-E. The supporting structures can be, for example but not limited to, stripe(s) of materials disposed over the injection port outlet with limited obstruction to airflow through the communication port. The supporting structure can be constructed from, for example but not limited to, the same material of the scroll member milled into or soldered over the communication port. The supporting structures are configured to be in contact with the tip seals and provide support to the tip seal in operation. The tip seal can glide over the supporting structures and have less wear and tear from cutting against large or sharp edges created by an open injection port and extending the lifespan of the tip seal. In some embodiments, the supporting structure can be configured to have, for example but not limited to, other shapes and structures to provide the function of supporting tip seal gliding over the communication port and reducing wear and tear on the tip seal.

In an embodiment, the compressors 500A-500E can be or include similar components with the compressor 10, 100, and 300 as shown and described in FIGS. 1, 2, 3A to 4C.

The injection port 126 and the injection port outlet 126A, 390 can be designed to minimize a pressure drop of the working fluid having an intermediate pressure. For example, an outlet diameter, an outlet shape, and combinations thereof can be controlled to provide the working fluid with a desired flowrate, overall efficiency, and the like.

In the illustrated examples of FIGS. 3A to 5D, the injection port or injection port outlet are shown to be disposed in the non-orbiting member (e.g., the non-orbiting member 110, 310). It is appreciated that the injection port and the injection port outlet can be disposed in the orbiting scroll member (e.g., the orbiting scroll member 108, 308).

Figure 6:
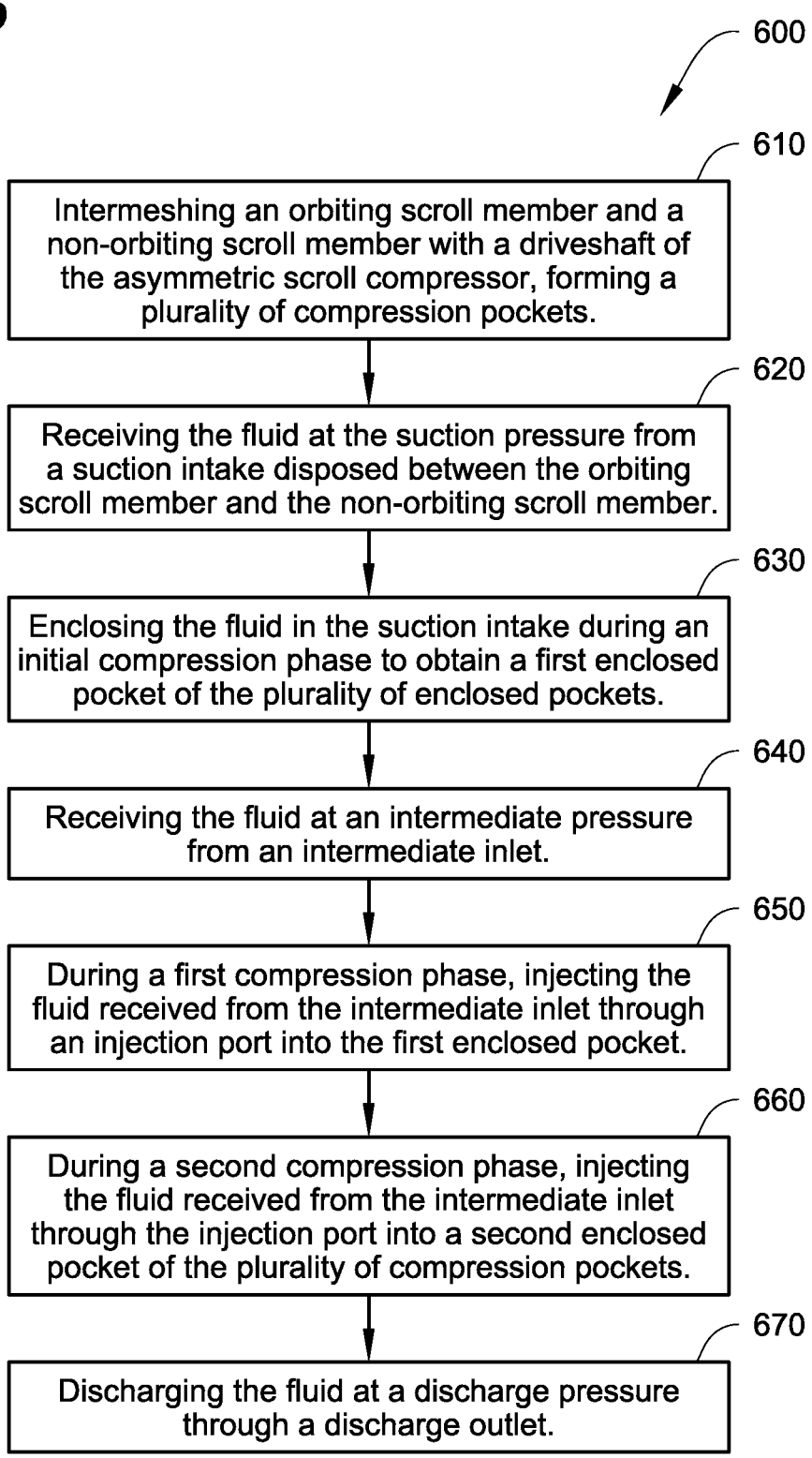
FIG. 6 is a block flow chart for a method of communicating an intermediate pressure working fluid, according to an embodiment.

FIG. 6 is a block flow chart for a method 600 of communicating working fluid at intermediate pressure with an asymmetric scroll compressor, according to an embodiment.

At a method step 610, an asymmetric scroll compressor rotates a driveshaft to orbit an orbiting scroll member affixed to the driveshaft from a first orbital position to a second orbital position to intermesh with a non-orbiting scroll member of the asymmetric scroll compressor, forming a plurality of compression pockets.

At a method step 620, the asymmetric scroll compressor receives the working fluid at a suction pressure from a suction intake disposed between the orbiting scroll member and the non-orbiting scroll member.

At a method step 630, the wraps enclose the working fluid in the suction intake to obtain a first enclosed pocket of the plurality of enclosed pocket.

At a method step 640, the asymmetric scroll compressor communicates with the working fluid at an intermediate pressure from a communication port. For example, the communication port can be fluidly connected to an economizer to receive working fluid at an intermediate pressure.

At a method step 650, the asymmetric scroll compressor, in the first orbital position, communicates with the first enclosed pocket of the plurality of compression pockets via the communication port.

At a method step 660, the asymmetric scroll compressor, in the second orbital position, communicates with a second enclosed pocket of the plurality of compression pockets via the communication port.

At a method step 670, the asymmetric scroll compressor discharges the fluid at a discharge pressure through a discharge outlet.

Aspects.

Aspect 1. An asymmetric scroll compressor comprising: a compressor housing; an orbiting scroll member and a non-orbiting scroll member disposed within the compressor housing, the orbiting scroll member and the non-orbiting scroll member each includes a baseplate and a wrap extending from the baseplate, the orbiting scroll member and the non-orbiting scroll member intermeshed to form a plurality of compression pockets; a driveshaft affixed to the orbiting scroll member and configured to orbit the orbiting scroll member from a first orbital position to a second orbital position; a communication port disposed on the baseplate of one of the orbiting scroll member and the non-orbiting scroll such that: in the first orbital position, the communication port communicates with a first enclosed pocket of the plurality of compression pockets, and in the second orbital position, the communication port communicates with a second enclosed pocket of the plurality of compression pockets.

Aspect 2. The asymmetric scroll compressor of aspect 1, wherein the orbiting scroll member has an intermediate orbital position between the first orbital position and the second orbital position, and during the intermediate orbital position, the communication port communicates with both the first enclosed pocket and the second enclosed pocket.

Aspect 3. The asymmetric scroll compressor of any of the aspects 1-2, wherein the first enclosed pocket and the second enclosed pocket are adjacent in a radial direction and separated by one of the wraps.

Aspect 4. The asymmetric scroll compressor of any of the aspects 1-3, wherein the first enclosed pocket and the second enclosed pocket are at or about a same pressure between the first orbital position and the second orbital position.

Aspect 5. The asymmetric scroll compressor of any of the aspects 1-4, further comprises a porous structure disposed in the communication port, the communication port configured to transfer fluid through the porous structure, and the porous structure configured to mitigate wear on a tip seal disposed on one of the wraps.

Aspect 6. The asymmetric scroll compressor of any of the aspects 1-5, wherein the communication port is disposed within the baseplate of the non-orbiting scroll member.

Aspect 7. A method of communicating working fluid at an intermediate pressure with an asymmetric scroll compressor, comprising: orbiting an orbiting scroll member affixed to a driveshaft from a first orbital position to a second orbital position to intermesh with a non-orbiting scroll member of the asymmetric scroll compressor, forming a plurality of compression pockets; receiving the working fluid at a suction pressure from a suction intake disposed between the orbiting scroll member and the non-orbiting scroll member; enclosing the working fluid in the suction intake to obtain a first enclosed pocket of the plurality of enclosed pocket; communicating the working fluid at an intermediate pressure from a communication port such that: in the first orbital position, communicating with the first enclosed pocket of the plurality of compression pockets via the communication port, and in the second orbital position, communicating with a second enclosed pocket of the plurality of compression pockets via the communication port; and discharging the working fluid at a discharge pressure through a discharge outlet.

Aspect 8. The method of aspect 7, wherein communicating with both the first enclosed pocket and the second enclosed pocket via the communication port in an intermediate orbital position, the intermediate orbital position being between the first orbital position and the second orbital positon.

Aspect 9. The method of any one of the aspects 7-8, wherein the orbiting scroll member and the non-orbiting scroll member each includes a baseplate and a wrap extending from the baseplate, and the first enclosed pocket and the second enclosed pocket are adjacent in a radial direction and separated by one of the wraps.

Aspect 10. The method of any one of the aspects 7-9, further comprising: maintaining the first enclosed pocket and the second enclosed pocket at or about a same pressure at the intermediate orbital position.

Aspect 11. The method of any one of the aspects 7-10, further comprising: orbiting the orbital scroll member from a suction orbital position to the first orbital position to enclose the working fluid in the suction intake.

Aspect 12. A refrigerant circuit, comprising: a compressor, an expander, a condenser, and an evaporator fluidly connected, wherein the compressor includes: a compressor housing; an orbiting scroll member and a non-orbiting scroll member disposed within the compressor housing, the orbiting scroll member and the non-orbiting scroll member each includes a baseplate and a wrap extending from the baseplate, the orbiting scroll member and the non-orbiting scroll member intermeshed to form a plurality of compression pockets; a driveshaft affixed to the orbiting scroll member configured to orbit the orbiting scroll member from a first orbital position to a second orbital position; a communication port disposed on the baseplate of one of the orbiting scroll member and the non-orbiting scroll such that: in the first orbital position, the communication port communicates with a first enclosed pocket of the plurality of compression pockets, and in the second orbital position, the communication port communicates with a second enclosed pocket of the plurality of compression pockets.

Aspect 13. The refrigerant circuit of aspect 12, wherein the orbiting scroll member has an intermediate orbital position between the first orbital position and the second orbital position, and during the intermediate orbital position, the communication port communicates with both the first enclosed pocket and the second enclosed pocket.

Aspect 14. The refrigerant circuit of any one of the aspects 12-13, wherein the first enclosed pocket and the second enclosed pocket are adjacent in a radial direction and are separated by one of the wraps.

Aspect 15. The refrigerant circuit of any one of the aspects 12-14, wherein the first enclosed pocket and the second enclosed pocket are at or about a same pressure during between the first orbital position and the second orbital position.

Aspect 16. The refrigerant circuit of any one of the aspects 12-15, wherein a porous structure disposed in the communication port, the communication port configured to transfer fluid through the porous structure, and the porous structure configured to mitigate wear on a tip seal disposed on one of the wraps.

Aspect 17. The refrigerant circuit of any one of the aspects 12-16, wherein the communication port is disposed within the baseplate of the non-orbiting scroll member.

Aspect 18. The refrigerant circuit of any one of the aspects 12-17, wherein the compressor housing includes an intermediate pressure fluid port, the intermediate pressure fluid port is configured to receive working fluid from an intermediate pressure fluid source, the communication port is configured to receive the working fluid at an intermediate pressure and inject the working fluid into the first enclosed pocket and the second enclosed pocket.

Aspect 19. The refrigerant circuit of any one of the aspects 12-18, wherein the compressor housing includes an intermediate pressure fluid port, the intermediate pressure fluid port is configured to discharge working fluid from both the first enclosed pocket and the second enclosed pocket, the communication port is configured to discharge the working fluid at an intermediate pressure.

Aspect 20. The refrigerant circuit of any one of the aspects 12-19, wherein the communication port is configured to discharge the working fluid at the intermediate pressure to a suction inlet disposed on the housing.

Aspect 21. The refrigerant circuit of any one of the aspects 12-20, wherein the communication port is configured to discharge the working fluid at the intermediate pressure to the condenser.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. An asymmetric scroll compressor comprising:

a compressor housing;

an orbiting scroll member and a non-orbiting scroll member disposed within the compressor housing, the orbiting scroll member and the non-orbiting scroll member each include a baseplate and a wrap extending from the baseplate, the orbiting scroll member and the non-orbiting scroll member intermeshed to form a plurality of compression pockets;

a driveshaft coupled to the orbiting scroll member and configured to orbit the orbiting scroll member from a first orbital position to a second orbital position;

a communication port including a communication port outlet having a comet shape, wherein the comet shape has a head connected to a tail, the communication port disposed on the baseplate of the non-orbiting scroll such that:

in the first orbital position, the communication port outlet communicates with a first enclosed pocket of the plurality of compression pockets, and in the second orbital position, the communication port outlet communicates with a second enclosed pocket of the plurality of compression pockets, wherein the orbiting scroll member has an intermediate orbital position between the first orbital position and the second orbital position such that:

in the intermediate orbital position, the communication port communicates with both the first enclosed pocket and the second enclosed pocket, wherein the communication port outlet spans across the wrap of the orbiting scroll member to extend onto both the first enclosed pocket and the second enclosed pocket, wherein a first portion of the head of the comet shape is located on the first enclosed pocket, the first portion of the head of the comet shape communicates with a length of the comet shape, and the length contains a portion of the tail and a second portion of the head of the comet shape that is different from the first portion of the head of e comet shape, and the second portion of the head and the portion of the tail are collectively located on the second enclosed pocket.

2. The asymmetric scroll compressor of claim 1, wherein the first enclosed pocket and the second enclosed pocket are adjacent in a radial direction and separated by one of the wraps.

3. The asymmetric scroll compressor of claim 1, wherein the first enclosed pocket and the second enclosed pocket are at or about a same pressure between the first orbital position and the second orbital position.

4. The asymmetric scroll compressor of claim 1, further comprises a porous material disposed in the communication port, the communication port configured to transfer fluid through the porous material, and the porous material configured to mitigate wear on a tip seal disposed on one of the wraps.

5. The asymmetric scroll compressor of claim 1, wherein the communication port is disposed within the baseplate of the non-orbiting scroll member.

6. The asymmetric scroll compressor of claim 1, wherein the communication port outlet is disposed in a porting envelope that is defined by an overlapping area from relative orbital movements of two adjacent compression pockets compressed by the non-orbiting scroll member and the orbiting scroll member.

7. The asymmetric scroll compressor of claim 6, wherein the porting envelope has a comet shape that includes a tail portion, and the tail of the comet shape of the communication port outlet is disposed in the tail portion of the comet shape of the porting envelope.

8. The asymmetric scroll compressor of claim 1, wherein the communication port outlet is disposed in a porting envelope.

9. A method of communicating working fluid at an intermediate pressure with an asymmetric scroll compressor, comprising:

orbiting an orbiting scroll member affixed to a driveshaft from a first orbital position to a second orbital position to intermesh with a non-orbiting scroll member of the asymmetric scroll compressor, forming a plurality of compression pockets, and the orbiting scroll member and the non-orbiting scroll member each include a baseplate and a wrap extending from the baseplate;

receiving the working fluid at a suction pressure from a suction intake disposed between the orbiting scroll member and the non-orbiting scroll member;

enclosing the working fluid in the suction intake to obtain a first enclosed pocket of the plurality of compression pockets;

communicating the working fluid at an intermediate pressure from a communication port that includes a communication port outlet having a comet shape, wherein the comet shape has a head connected to a tail, the communication port disposed on a baseplate of the non-orbiting scroll such that:

in the first orbital position, communicating with the first enclosed pocket of the plurality of compression pockets via the communication port outlet, and in the second orbital position, communicating with a second enclosed pocket of the plurality of compression pockets via the communication port outlet; and discharging the working fluid at a discharge pressure through a discharge outlet, wherein the orbiting scroll member has an intermediate orbital position between the first orbital position and the second orbital position such that:

in the intermediate orbital position, the communication port communicates with both the first enclosed pocket and the second enclosed pocket, wherein the communication port outlet spans across the wrap of the orbiting scroll member to extend onto both the first enclosed pocket and the second enclosed pocket, wherein a first portion of the head of the comet shape is located on the first enclosed pocket, the first portion of the head of the comet shape communicates with a length of the comet shape, and the length contains a portion of the tail and a second portion of the head of the comet shape that is different from the first portion of the head of the comet shape, and the second portion of the head and the portion of the tail are collectively located on the second enclosed pocket.

10. The method of claim 9, wherein the first enclosed pocket and the second enclosed pocket are adjacent in a radial direction and separated by one of the wraps.

11. The method of claim 9, further comprising:

maintaining the first enclosed pocket and the second enclosed pocket at or about a same pressure at the intermediate orbital position.

12. The method of claim 9, further comprising:

orbiting the orbital scroll member from a suction orbital position to the first orbital position to enclose the working fluid in the suction intake.

13. A refrigerant circuit, comprising:

an asymmetric scroll compressor, an expander, a condenser, and an evaporator fluidly connected, wherein the asymmetric scroll compressor includes:

a compressor housing;

an orbiting scroll member and a non-orbiting scroll member disposed within the compressor housing, the orbiting scroll member and the non-orbiting scroll member each include a baseplate and a wrap extending from the baseplate, the orbiting scroll member and the non-orbiting scroll member intermeshed to form a plurality of compression pockets;

a driveshaft affixed to the orbiting scroll member configured to orbit the orbiting scroll member from a first orbital position to a second orbital position;

a communication port including a communication port outlet having a comet shape, wherein the comet shape has a head connected to a tail, the communication port disposed on the baseplate of the non-orbiting scroll such that:

in the first orbital position, the communication port outlet communicates with a first enclosed pocket of the plurality of compression pockets, and in the second orbital position, the communication port outlet communicates with a second enclosed pocket of the plurality of compression pockets, wherein the orbiting scroll member has an intermediate orbital position between the first orbital position and the second orbital position such that:

in the intermediate orbital position, the communication port communicates with both the first enclosed pocket and the second enclosed pocket, wherein the communication port outlet spans across the wrap of the orbiting scroll member to extend onto both the first enclosed pocket and the second enclosed pocket, wherein a first portion of the head of the comet shape is located on the first enclosed pocket, the first portion of the head of the comet shape communicates with a length of the comet shape, and the length contains a portion of the tail and a second portion of the head of the comet shape that is different from the first portion of the head of the comet shape, and the second portion of the head and the portion of the tail are collectively located on the second enclosed pocket.

14. The refrigerant circuit of claim 13, wherein the first enclosed pocket and the second enclosed pocket are adjacent in a radial direction and are separated by one of the wraps.

15. The refrigerant circuit of claim 13, wherein the first enclosed pocket and the second enclosed pocket are at or about a same pressure during between the first orbital position and the second orbital position.

16. The refrigerant circuit of claim 13, wherein a porous material is disposed in the communication port, the communication port is configured to transfer fluid through the porous material, and the porous material is configured to mitigate wear on a tip seal disposed on one of the wraps.

17. The refrigerant circuit of claim 13, wherein the communication port is disposed within the baseplate of the non-orbiting scroll member.

18. The refrigerant circuit of claim 13, wherein the compressor housing includes an intermediate pressure fluid port, the intermediate pressure fluid port is configured to receive working fluid from an intermediate pressure fluid source, and the communication port is configured to receive the working fluid at an intermediate pressure and inject the working fluid into the first enclosed pocket and the second enclosed pocket.

19. The refrigerant circuit of claim 13, wherein the compressor housing includes an intermediate pressure fluid port, the intermediate pressure fluid port is configured to discharge working fluid from both the first enclosed pocket and the second enclosed pocket, and the communication port is configured to discharge the working fluid at an intermediate pressure.

20. The refrigerant circuit of claim 19, Wherein the communication port is configured to discharge the working fluid at the intermediate pressure to a suction inlet disposed on the housing.

* * * * *